US006467463B2

(12) United States Patent
Kitamura et al.

(10) Patent No.: US 6,467,463 B2
(45) Date of Patent: Oct. 22, 2002

(54) ABNORMALITY DIAGNOSIS APPARATUS FOR EVAPORATIVE EMISSION CONTROL SYSTEM

(75) Inventors: Toru Kitamura, Wako (JP); Makoto Kobayashi, Wako (JP); Takeshi Suzuki, Wako (JP); Toshiaki Ichitani, Wako (JP); Tetsuya Ishiguro, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/756,201

(22) Filed: Jan. 9, 2001

(65) Prior Publication Data

US 2001/0008136 A1 Jul. 19, 2001

(30) Foreign Application Priority Data

Jan. 14, 2000 (JP) ..... 2000-006578

(51) Int. Cl.[7] ..... F02M 37/04
(52) U.S. Cl. ..... 123/516; 123/520
(58) Field of Search ..... 123/520, 519, 123/518, 516, 198 D, 521; 73/116, 117.3; 701/114

(56) References Cited

U.S. PATENT DOCUMENTS 5,375,579 A * 12/1994 Mukai ..... 123/520
5,398,662 A * 3/1995 Igarashi et al. ..... 123/520
5,918,581 A * 7/1999 Uto et al. ..... 123/520

FOREIGN PATENT DOCUMENTS

| | | |
|---|---|---|
| JP | A-5-195881 | 8/1993 |
| JP | A-9-317572 | 12/1997 |
| JP | A-10-281019 | 10/1998 |

* cited by examiner

*Primary Examiner*—Willis R. Wolfe
*Assistant Examiner*—Mahmoud Gimie
(74) *Attorney, Agent, or Firm*—Arent Fox Kintner Plotkin & Kahn, PLLC

(57) ABSTRACT

An abnormality diagnosis apparatus for an evaporative emission control system which includes a fuel tank, a canister for adsorbing evaporative fuel generated in the fuel tank, an evaporative fuel passage connecting the fuel tank and an intake system, a first control valve interposed in a charging passage, a second control valve interposed in a purge passage, a third control valve interposed in a vent passage, and a fourth control valve interposed in the evaporative fuel passage for opening and closing the evaporative fuel passage. An abnormality of the evaporative emission control system is diagnosed based on a detected pressure in the fuel tank. During the abnormality diagnosis, the fourth control valve is controlled to be maintained in a closed state, and the abnormality diagnosis is performed by changing an open or closed state of at least one of the first, second and third control valves without opening the first and third control valves simultaneously.

12 Claims, 12 Drawing Sheets

ABNORMALITY DIAGNOSIS APPARATUS FOR EVAPORATIVE EMISSION CONTROL SYSTEM

BACKGROUND OF THE INVENTION

This invention relates to an abnormality diagnosis apparatus for an evaporative emission control system which prevents emission of evaporative fuel generated in a fuel tank from which fuel is supplied to an internal combustion engine, and more particularly to an abnormality diagnosis apparatus for such a system that the emission of evaporative fuel is prevented by maintaining the pressure in a fuel tank at a negative pressure.

An apparatus is disclosed, for example, in Japanese Patent Laid-Open No. Hei 10-281019 wherein an intake pipe of an internal combustion engine and a fuel tank are connected directly to each other by an evaporative fuel passage and the pressure in the fuel tank is maintained at a negative pressure (pressure lower than atmospheric pressure) to prevent emission of evaporative fuel. Also an abnormality diagnosis method is disclosed, for example, in Japanese Patent Laid-Open No. Hei 5-195881 or Japanese Patent Laid-Open No. Hei 9-317572, wherein a canister for temporarily storing evaporative fuel is provided and usually the pressure in a fuel tank is maintained at a pressure around atmospheric pressure, whereas the pressure in the fuel tank is reduced to a negative pressure only when the abnormality diagnosis is performed.

In the conventional abnormality diagnosis method described above, the pressure in the fuel tank is set to a negative pressure after setting the pressure in the fuel tank to atmospheric pressure, and an abnormality is diagnosed based on the change in the pressure in the fuel tank during such a procedure. Therefore, if the conventional abnormality diagnosis method is applied to an evaporative emission control system where the pressure in the fuel tank is normally maintained at a negative pressure to prevent emission of evaporative fuel, then it is necessary to raise the pressure in the fuel tank to atmospheric pressure to diagnose an abnormality. Therefore, after the abnormality diagnosis comes to an end, the pressure in the fuel tank must be reduced to a negative pressure again. Consequently, a problem arises that energy required to control the pressure in the fuel tank to a negative pressure is consumed wastefully.

SUMMARY OF THE INVENTION

It is an object of the present invention to provide an abnormality diagnosis apparatus which can diagnose an abnormality such as a failure of a control valve or a leak in a canister used in an evaporative emission control system in which the pressure in a fuel tank is normally maintained at a negative pressure to prevent emission of evaporative fuel, maintaining the pressure in the fuel tank at a negative pressure, to thereby eliminate wasteful consumption of energy.

In order to attain the object described above, according to the present invention, there is provided an abnormality diagnosis apparatus for an evaporative emission control system which includes a fuel tank, a canister for adsorbing evaporative fuel generated in the fuel tank, a charging passage for connecting the canister and the fuel tank, a purge passage for connecting the canister and an intake system of an internal combustion engine, a vent passage for opening the canister to atmospheric air, an evaporative fuel passage for connecting the fuel tank and the intake system, a first control valve interposed in the charging passage for opening and closing the charging passage, a second control valve interposed in the purge passage for opening and closing the purge passage, a third control valve interposed in the vent passage for opening and closing the vent passage, a fourth control valve interposed in the evaporative fuel passage for opening and closing the evaporative fuel passage, and control means for controlling an opening of the fourth control valve so that a pressure in the fuel tank may be maintained at a predetermined pressure lower than atmospheric pressure at least during operation of the internal combustion engine. The abnormality diagnosis apparatus comprises tank pressure detecting means for detecting the pressure in the fuel tank; and abnormality diagnosis means for diagnosing abnormality of the evaporative emission control system based on an output of the tank pressure detecting means; wherein the controlling means outputs a control signal for maintaining the fourth control valve in a closed state while an abnormality diagnosis is performed by the abnormality diagnosis means, and the abnormality diagnosis means performs an abnormality diagnosis by outputting a control signal for changing an open or closed state of at least one of the first, second and third control valves without opening the first and third control valves simultaneously.

With this configuration, the abnormality diagnosis is performed by outputting a control signal for maintaining the fourth control valve, which opens and closes the evaporative fuel passage, in a closed state and outputting another control signal for changing an open or closed state of at least one of the first control valve, which opens and closes the charging passage, the second control valve, which opens and closes the purge passage, and the third control valve, which opens and closes the vent passage, without opening the first and third control valves simultaneously. Therefore, the internal pressure of the fuel tank can be maintained at the negative pressure throughout execution of the abnormality diagnosis, and pressure loss by the abnormality diagnosis can be prevented to eliminate wasteful consumption of energy.

Preferably, the abnormality diagnosis means outputs control signals for closing the first, second and third control valves, outputs a control signal for opening the first control valve, and determines an open failure of the second control valve or a close failure of the first control valve based on a change in the pressure in the fuel tank after outputting the control signal for opening the first control valve.

Preferably, the abnormality diagnosis means determines that an open failure of the second control valve or a close failure of the first control valve has occurred when the amount of change in the pressure in the fuel tank is smaller than or equal to a first predetermined change amount.

Preferably, the abnormality diagnosis means outputs control signals for closing the first, second and third control valves, outputs a control signal for opening the first control valve, outputs a control signal for opening the second control valve, and determines a close failure of the second control valve based on a change in the pressure in the fuel tank after outputting the control signal for opening the second control valve.

Preferably, the abnormality diagnosis means determines that a close failure of the second control valve has occurred when the amount of change in the pressure in the fuel tank is smaller than or equal to a second predetermined change amount.

Preferably, the abnormality diagnosis apparatus further comprises intake air pressure detecting means for detecting an intake air pressure in the intake system. In this apparatus, the abnormality diagnosis means inhibits determination of a failure of the second control valve when an absolute value of a difference between the pressure in the fuel tank and the intake air pressure in the intake system is less than or equal to a predetermined value.

Preferably, the abnormality diagnosis means outputs control signals for maintaining the first, second and third control valves in a closed state in a condition where a pressure in the canister is lower than atmospheric pressure, outputs a control signal for opening the first control valve at a time when a predetermined stabilization period has elapsed, and determines whether or not there exists a leak in the canister based on a change in the pressure in the fuel tank after outputting the control signal for opening the first control valve.

Preferably, the abnormality diagnosis means outputs control signals for maintaining the first, second and third control valves in a closed state after the determination of a close failure of the second control valve, outputs a control signal for opening the first control valve at a time when a predetermined stabilization period has elapsed, and determines whether or not there exists a leak in the canister based on a change in the pressure in the fuel tank after outputting the control signal for opening the first control valve.

Preferably, the abnormality diagnosis means determines that there exists a leak in the canister when the amount of change in the pressure in the fuel tank is greater than or equal to a third predetermined change amount.

Preferably, the abnormality diagnosis means determines that there exists a leak in the canister when the amount of change in the pressure in the fuel tank is greater than or equal to a third predetermined change amount.

Preferably, the abnormality diagnosis means outputs control signals for maintaining the first, second and third control valves in a closed state in a condition where a pressure in the canister is lower than atmospheric pressure, outputs a control signal for opening the third control valve, outputs a control signal for closing the third control valve, outputs a control signal for opening the first control valve, and determines a close failure of the third control valve based on a change in the pressure in the fuel tank after outputting the control signal for opening the first control valve.

Preferably, the abnormality diagnosis means determines that a close failure of the third control means has occurred when the amount of change in the pressure in the fuel tank is smaller than or equal to a fourth predetermined change amount.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

A preferred embodiment of the present invention will now be described with reference to the drawings.

Figure 1:
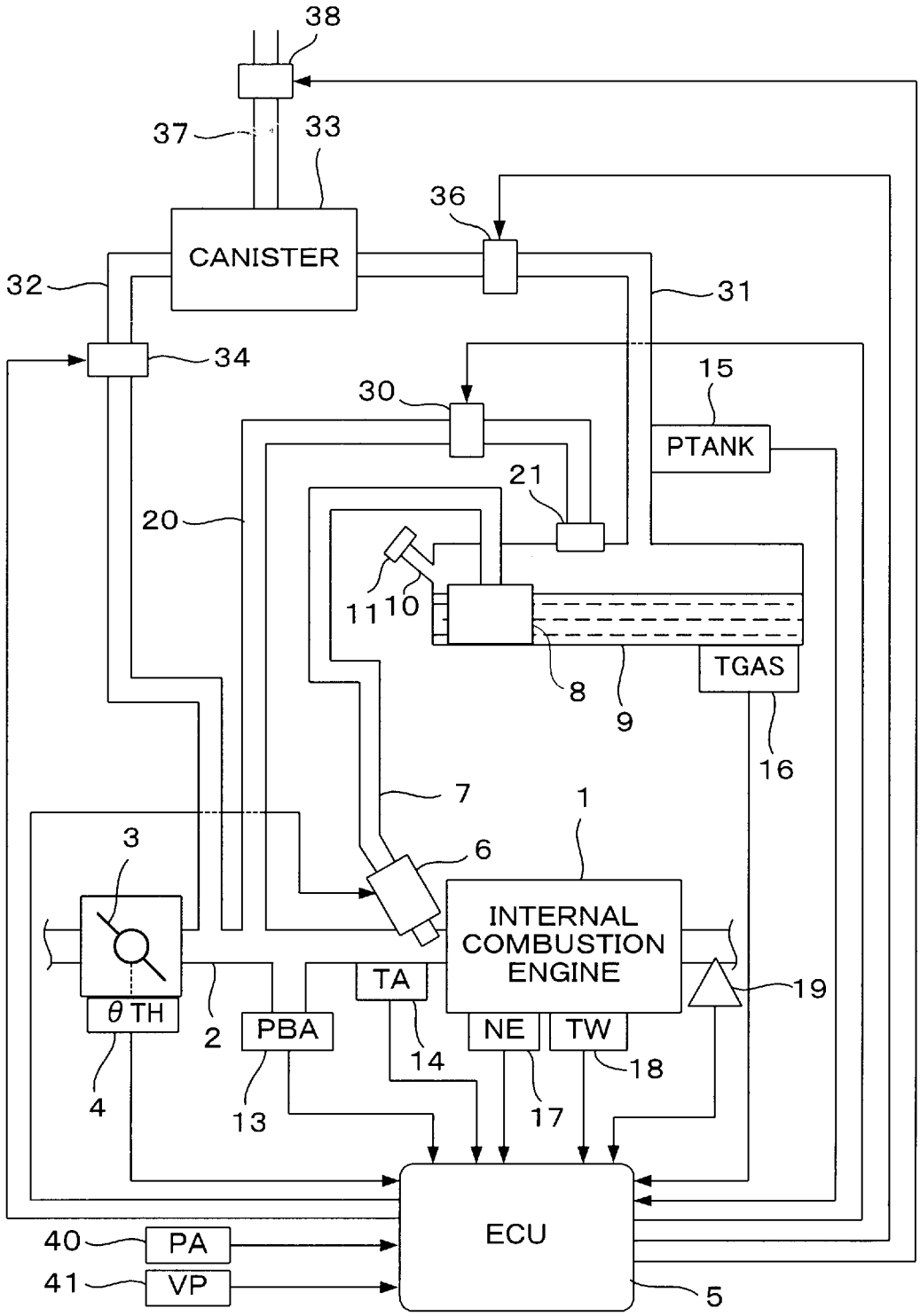
FIG. 1 is a schematic diagram showing the configuration of an evaporative emission control system and an abnormality diagnosis apparatus therefor according to an embodiment of the present invention.

FIG. 1 is a schematic diagram showing the configuration of an evaporative emission control system for an internal combustion engine according to a preferred embodiment of the present invention. Referring to FIG. 1, reference numeral 1 denotes an internal combustion engine (which will be hereinafter referred to simply as "engine") having a plurality of (e.g., four) cylinders. The engine 1 is provided with an intake pipe 2, in which a throttle valve 3 is mounted. A throttle valve opening θ TH sensor 4 is connected to the throttle valve 3. The throttle valve opening sensor 4 outputs an electrical signal corresponding to the opening angle of the throttle valve 3 and supplies the electrical signal to an electronic control unit (which will be hereinafter referred to as "ECU") 5.

Fuel injection valves, only one of which is shown, are inserted into the intake pipe 2 at locations intermediate between the cylinder block of the engine 1 and the throttle valve 3 and slightly upstream of the respective intake valves (not shown). All the fuel injection valves 6 are connected through a fuel supply pipe 7 to a fuel pump unit 8 provided in a fuel tank 9 having a hermetic structure. The fuel pump unit 8 is configured by integrating a fuel pump, a fuel strainer, and a pressure regulator having a reference pressure set to an atmospheric pressure or tank pressure. The fuel tank 9 has a fuel inlet 10 for use in refueling, and a filler cap 11 is mounted on the fuel inlet 10.

Each fuel injection valve 6 is electrically connected to the ECU 5, and its valve opening period is controlled by a signal from the ECU 5. The intake pipe 2 is provided with an intake pipe absolute pressure PBA sensor 13 for detecting an absolute pressure PBA in the intake pipe 2 and an intake air temperature TA sensor 14 for detecting an air temperature TA in the intake pipe 2 at positions downstream of the throttle valve 3. The fuel tank 9 is provided with a tank pressure sensor 15 as the tank pressure detecting means for detecting a pressure in the fuel tank 9, i.e., a tank pressure PTANK, and a fuel temperature TGAS sensor 16 for detecting a fuel temperature TGAS in the fuel tank 9.

An engine rotational speed NE sensor 17 for detecting an engine rotational speed is disposed near the outer periphery of a camshaft or a crankshaft (both not shown) of the engine 1. The engine rotational speed sensor 17 outputs a pulse (TDC signal pulse) at a predetermined crank angle per 180° rotation of the crankshaft of the engine 1. There are also provided an engine coolant temperature sensor 18 for detecting a coolant temperature TW of the engine 1 and an oxygen concentration sensor (which will be hereinafter referred to as "LAF sensor") 19 for detecting an oxygen concentration in exhaust gases from the engine 1. Detection signals from these sensors 13 to 19 are supplied to the ECU 5. The LAF sensor 19 functions as a wide-area air-fuel ratio sensor adapted to output a signal substantially proportional to an oxygen concentration in exhaust gases (proportional to an air-fuel ratio of air-fuel mixture supplied to the engine 1).

Further, an atmospheric pressure sensor 40 for detecting atmospheric pressure PA and a vehicle speed sensor 41 for detecting a running speed (vehicle speed) VP of a vehicle on which the engine 1 is mounted are connected to the ECU 5. Detection signals of the sensors 40 and 41 are supplied to the ECU 5.

There will now be described a configuration for reducing the pressure in the fuel tank 9 to a negative pressure. The fuel tank 9 is connected through a first evaporative fuel passage 20 to the intake pipe 2 at a position downstream of the throttle valve 3. The first evaporative fuel passage 20 is provided with a tank pressure control valve 30 (the fourth control valve) for opening and closing the first evaporative fuel passage 20 to control the pressure in the fuel tank 9. The tank pressure control valve 30 is a solenoid valve for controlling the flow of evaporative fuel from the fuel tank 9 to the intake pipe 2 by changing the on-off duty ratio of a control signal received (the opening degree of the control valve). The operation of the control valve 30 is controlled by the ECU 5. The control valve 30 may be a linearly controlled type solenoid valve whose opening degree is continuously changeable.

A cut-off valve 21 is provided at the connection between the evaporative fuel passage 20 and the fuel tank 9. The cut-off valve 21 is a float valve adapted to be closed when the fuel tank 9 is filled up or when the inclination of the fuel tank 9 is increased.

There will now be described a configuration for preventing the emission of evaporative fuel in the fuel tank 9 into the atmosphere in refueling. A canister 33 is connected through a charging passage 31 to the fuel tank 9, and is also connected through a purging passage 32 to the intake pipe 2 at a position downstream of the throttle valve 3.

The charging passage 31 is provided with a charge control valve 36 (the first control valve). The operation of the charge control valve 36 is controlled by the ECU 5 in such a manner that the charge control valve 36 is opened in refueling to introduce the evaporative fuel from the fuel tank 9 to the canister 33, and is otherwise closed. In this preferred embodiment, however, the charge control valve 36 is opened when the abnormality diagnosis described below is performed.

The canister 33 contains active carbon for adsorbing the evaporative fuel in the fuel tank 9. The canister 33 is adapted to communicate with the atmosphere through a vent passage 37.

The vent passage 37 is provided with a vent shut valve 38 (the third control valve). The vent shut valve 38 is a normally closed valve, and its operation is controlled by the ECU 5 in such a manner that the vent shut valve 38 is opened in refueling or during purging, and is otherwise closed. However, the vent shut valve 38 is opened and closed when the abnormality diagnosis described below is performed.

The purging passage 32 connected between the canister 33 and the intake passage 2 is provided with a purge control valve 34 (the second control valve). The purge control valve 34 is a solenoid valve capable of continuously controlling the flow by changing the on-off duty ratio of a control signal received (the opening degree of the control valve). The operation of the purge control valve 34 is controlled by the ECU 5.

It is to be noted that, in the following description, the canister 33 of the evaporative emission control system and the components around the canister 33 (the charge control valve 36, the portion of the charging passage 31 which is the downstream side (canister 33 side) with respect to the charge control valve 36, the purge control valve 34, the portion of the purge passage 32 which is the upstream side (canister 33 side) with respect to the purge control valve 34, the vent passage 37, and the vent shut valve 38) are referred to as "canister system".

The ECU 5 includes an input circuit having various functions including a function of shaping the waveforms of input signals from the various sensors, a function of correcting the voltage levels of the input signals to a predetermined level, and a function of converting analog signal values into digital signal values, a central processing unit (which will be hereinafter referred to as "CPU"), memories preliminarily storing various operational programs to be executed by the CPU and for storing the results of computation or the like by the CPU, and an output circuit for supplying drive signals to the fuel injection valves 6, the tank pressure control valve 30, the purge control valve 34, the charge control valve 36, and the vent shut valve 38.

The CPU of the ECU 5 controls the amount of fuel to be supplied to the engine 1 according to output signals from the various sensors including the engine rotational speed sensor 17, the intake pipe absolute pressure sensor 13, and the engine coolant temperature sensor 18.

Further, the CPU of the ECU 5 controls the operation of the various solenoid valves according to various conditions as in refueling or in the normal operation of the engine 1 in the following manner. In refueling, the charge control valve 36 and the vent shut valve 38 are opened as mentioned above. Accordingly, the evaporative fuel generated in the fuel tank 9 by refueling is stored into the canister 33 through the charge control valve 36, and the air separated from the fuel is released through the vent shut valve 38 into the atmosphere. Thus, the emission of the evaporative fuel into the atmosphere in refueling can be prevented.

In the normal operation of the engine 1, the charge control valve 36 is closed and the vent shut valve 38 is opened. In this condition, the purge control valve 34 is controlled to be opened to thereby apply the negative pressure in the intake pipe 2 to the canister 33. Accordingly, atmospheric air is supplied through the vent shut valve 38 to the canister 33, and the fuel adsorbed by the canister 33 is purged through the purge control valve 34 into the intake pipe 2. Thus, the evaporative fuel generated in the fuel tank 9 is not released into the atmosphere, but is supplied to the intake pipe 2, then being subjected to combustion in the combustion chamber of the engine 1. Further, if predetermined conditions are satisfied in the normal operation of the engine 1, the tank pressure control valve 30 is opened to apply the negative pressure in the intake pipe 2 directly to the fuel tank 9, thereby performing the negative pressurization control for reducing the pressure PTANK in the fuel tank 9 to a target pressure which is lower than atmospheric pressure. In this case, the target pressure P0 is set taking an estimated rise amount of the tank pressure PTANK into consideration so that the negative pressure in the fuel tank 9 may be maintained also after stoppage of the engine 1, as disclosed, for example, in Japanese Patent Laid-Open No. Hei 10-281019. The target pressure P0 may be set as an absolute pressure or may alternatively be set so that the pressure difference between the tank pressure and atmospheric pressure may be a predetermined pressure (for example, approximately 40 to 47 kPa (=300 to 350 mmHg)).

Figure 2:
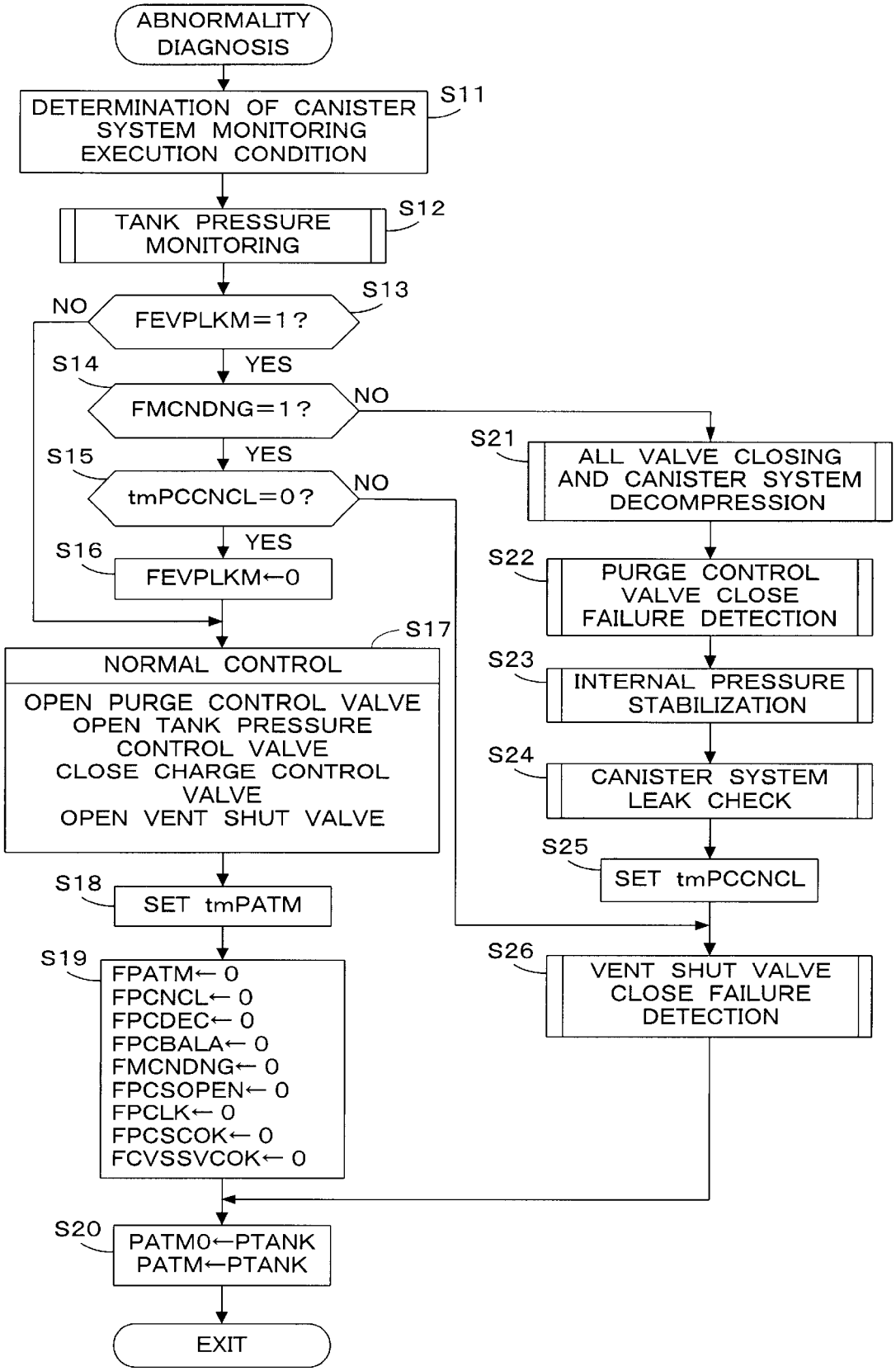
FIG. 2 is a flowchart of an abnormality diagnosis processing executed by an electronic control unit which constitutes the abnormality diagnosis apparatus.

An abnormality diagnosis of the evaporative emission control system having the configuration described hereinabove with reference to FIG. 1 is described with reference to FIGS. 2 to 12. FIG. 2 is a flowchart illustrating a processing for performing an abnormality diagnosis during operation of the engine 1. The processing of FIG. 2 is executed at predetermined time intervals (for example, 82 msec) by the CPU of the ECU 5. FIG. 12 is a time chart illustrating an abnormality diagnosis of the canister system in the present embodiment and is suitably referred to in the following description with reference to the flowcharts.

The abnormality diagnosis in the present embodiment includes detection of a failure that, even if a valve opening control signal or a valve closing control signal is outputted to a solenoid valve such as the purge control valve 34 or the vent shut valve 38, a valve opening operation or a valve closing operation of the valve is not performed normally. Accordingly, in the following description of the abnormality diagnosis processing, the wording "to open a valve" or "to close a valve" more precisely means "to output a control signal for opening a valve" or to "output a control signal for closing a valve".

Further, in the following description, "open valve failure" or "open failure" is used to mean a failure that a valve does not close even if a control signal for closing the valve is outputted to the valve, and "closed valve failure" or "close failure" is used to mean another failure that a valve does not open even if a control signal for opening the valve is outputted to the valve.

In step S11, determination of a canister system monitoring execution condition, that is, determination of whether or not abnormality diagnosis carrying out conditions of the canister system is satisfied, is executed. The canister system monitoring execution condition is satisfied when the evaporative fuel adsorbed in the canister 33 is being purged to the intake pipe 2, the operating state of the engine is in a predetermined steady state, the vehicle is in a cruising state in which a change in the vehicle speed VP is small or in a stopping state, an air-fuel ratio correction coefficient KLAF used for correcting the amount of fuel to be supplied to the engine 1 is higher than a predetermined value, which means that the influence of the purged fuel is low, and the fuel tank pressure PTANK is lower than 60 kPa (=450 mmHg). However, if the tank pressure PTANK rises from the pressure which is lower than or equal to 60 kPa, it is determined that the canister system monitoring execution condition is not satified when the tank pressure PTANK exceeds 88 kPa (=660 mmHg). When the canister system monitoring execution condition is satisfied, a canister system monitoring permission flag FEVPLKM is set to "1", but when the condition is not satisfied, the canister system monitoring permission flag FEVPLKM is set to "0".

Figure 3:
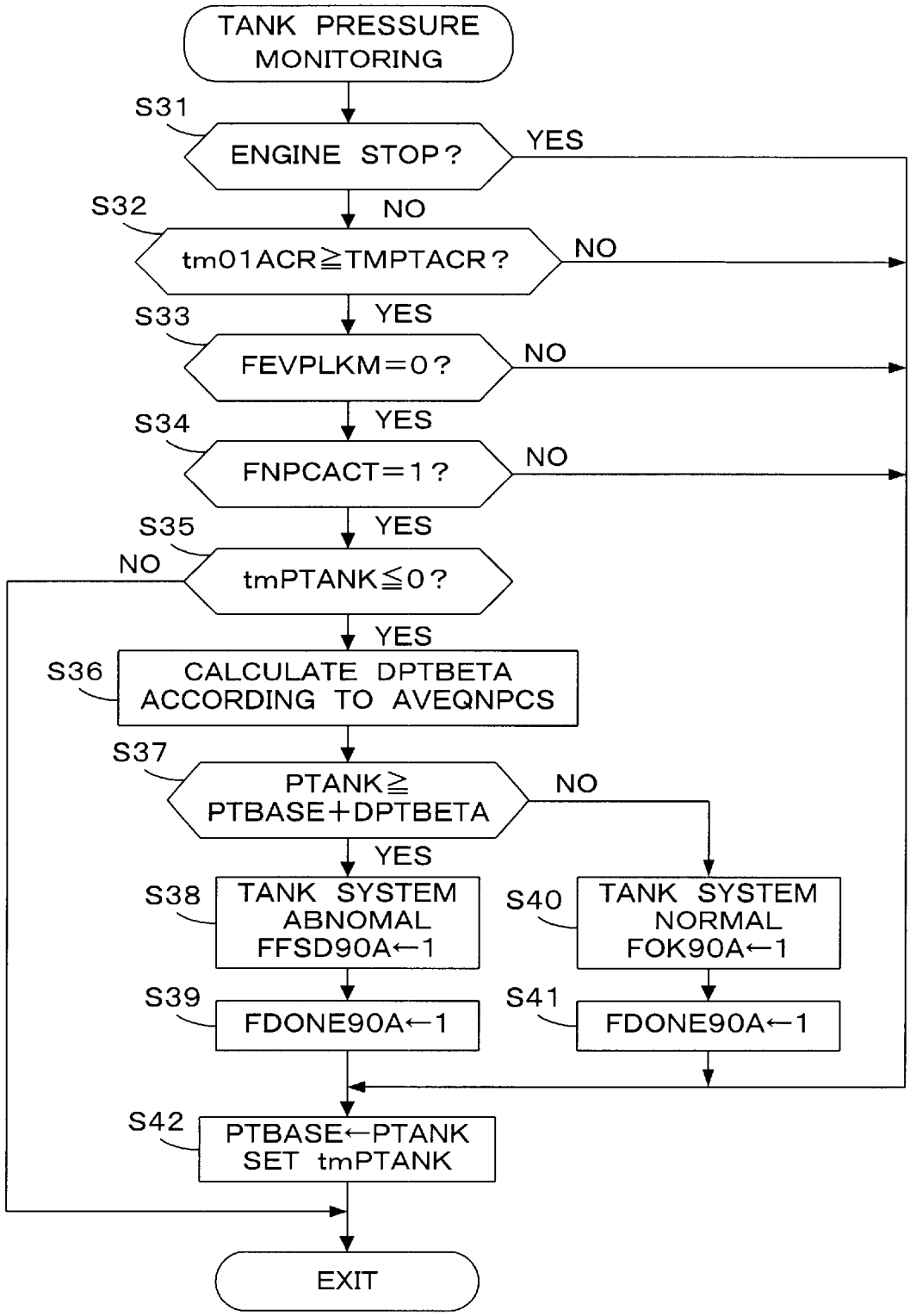
FIG. 3 is a flowchart of a tank pressure monitoring processing included in the processing of FIG. 2.

In next step S12, a tank pressure monitoring processing illustrated in FIG. 3 is executed. Then, it is determined whether or not the canister system monitoring permission flag FEVPLKM is equal to "1" (step S13). If FEVPLKM is "0" indicating that execution of an abnormality diagnosis is not permitted, then normal control is executed (step S17). That is, the purge control valve 34, tank pressure control valve 30 and vent shut valve 38 are opened while the charge control valve 36 is closed so that the inside of the fuel tank is maintained in a predetermined negative pressure state and the evaporative fuel stored in the canister 33 is purged to the intake pipe 2.

In next step S 18, a down count timer tmPATM for determining a timing at which the tank pressure PTANK is stored as a stored value PATM is set to a predetermined time TMPATM (for example, 12 seconds) and started, and then various flags to be used in processings hereinafter described are all set to "0" (step S19). Specifically, a storage completion flag FPATM (refer to step S61 of FIG. 5) which indicates, when set to "1", that the tank pressure PTANK is stored as the stored value PATM at a time when the predetermined time TMPATM has elapsed from the start of an abnormality diagnosis of the canister system, a VSV failure determination flag FPCNCL which indicates, when set to "1", that failure determination of the vent shut valve 38 (FIG. 10) is to be executed, a PCV close failure determination flag FPCDEC which indicates, when set to "1", that close failure determination of the purge control valve 34 (FIG. 7) is to be executed, an internal pressure stabilization flag FPCBALA which indicates, when set to "1", that an internal pressure stabilization processing (FIG. 8) for stabilizing the pressure in the canister 33 when there exists a leak in the canister 33, a VSV check start flag FMCNDNG which indicates, when set to "1", that processing of steps S21 to S25 is not to be executed after a vent shut valve close failure detection processing is started, a PCV open failure detection flag FPCSOPEN which indicates, when set to "1", that the canister system is to be decompressed and an open failure detection processing of the purge control valve 34 (FIG. 6) is to be executed, a leak check flag FPCLK which indicates, when set to "1", that a leak check of the canister system (FIG. 9) is to be executed, a PCVOK flag FPCSOK which indicates, when set to "1", that an open failure of the purge control valve 34 does not occur, and a VSVOK flag FCVSSVCOK which indicates, when set to "1", that an open valve failure of the vent shut valve 38 does not occur, are all set to "0".

In next step S20, a present value of the tank pressure PTANK is stored as an initial pressure PATMO, and the stored value PATM is initialized with the present value of the tank pressure PTANK. Thereafter the present processing is ended.

Figure 9:
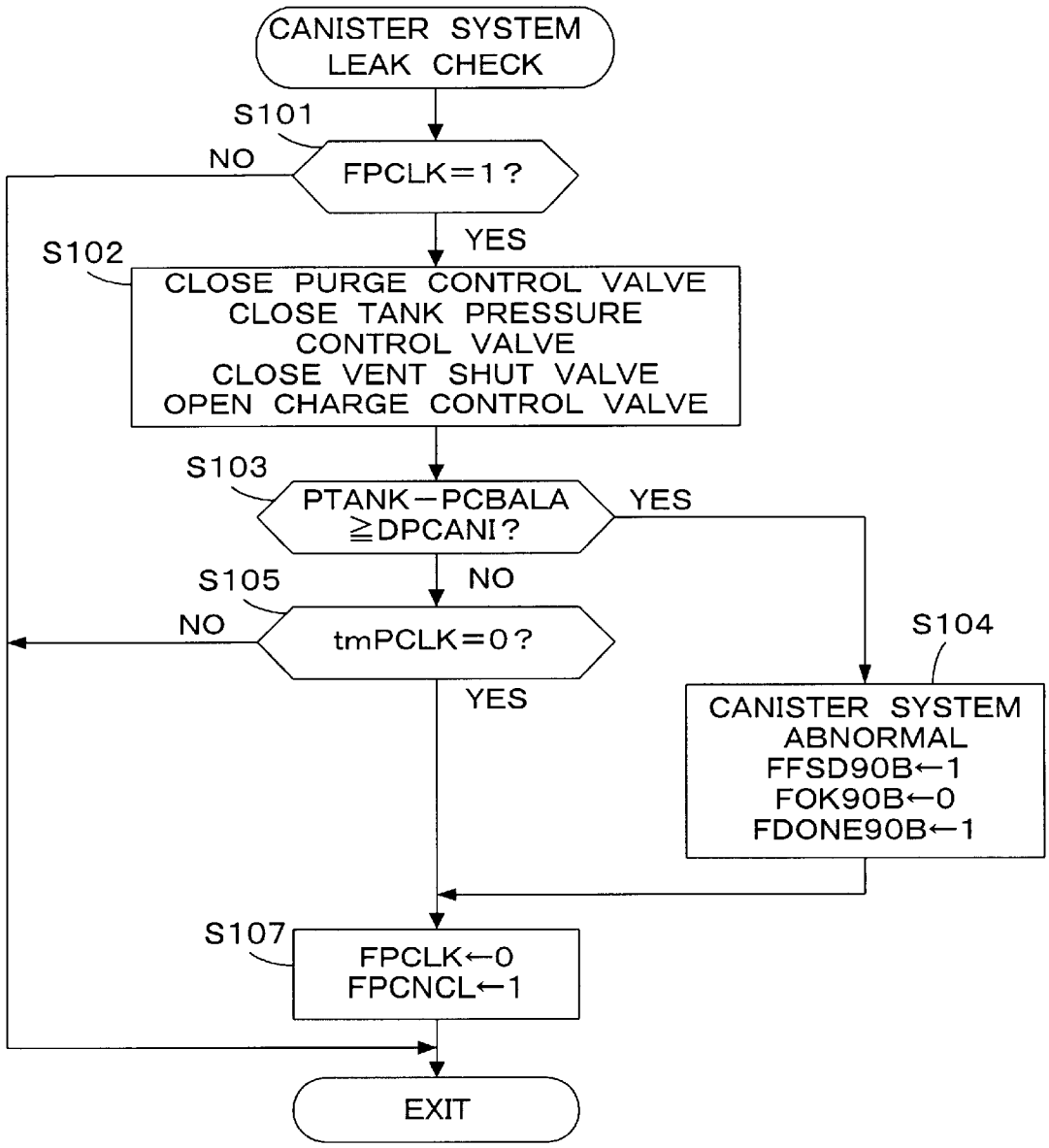
FIG. 9 is a flowchart of a canister system leak check processing included in the processing of FIG. 2
Figure 10:
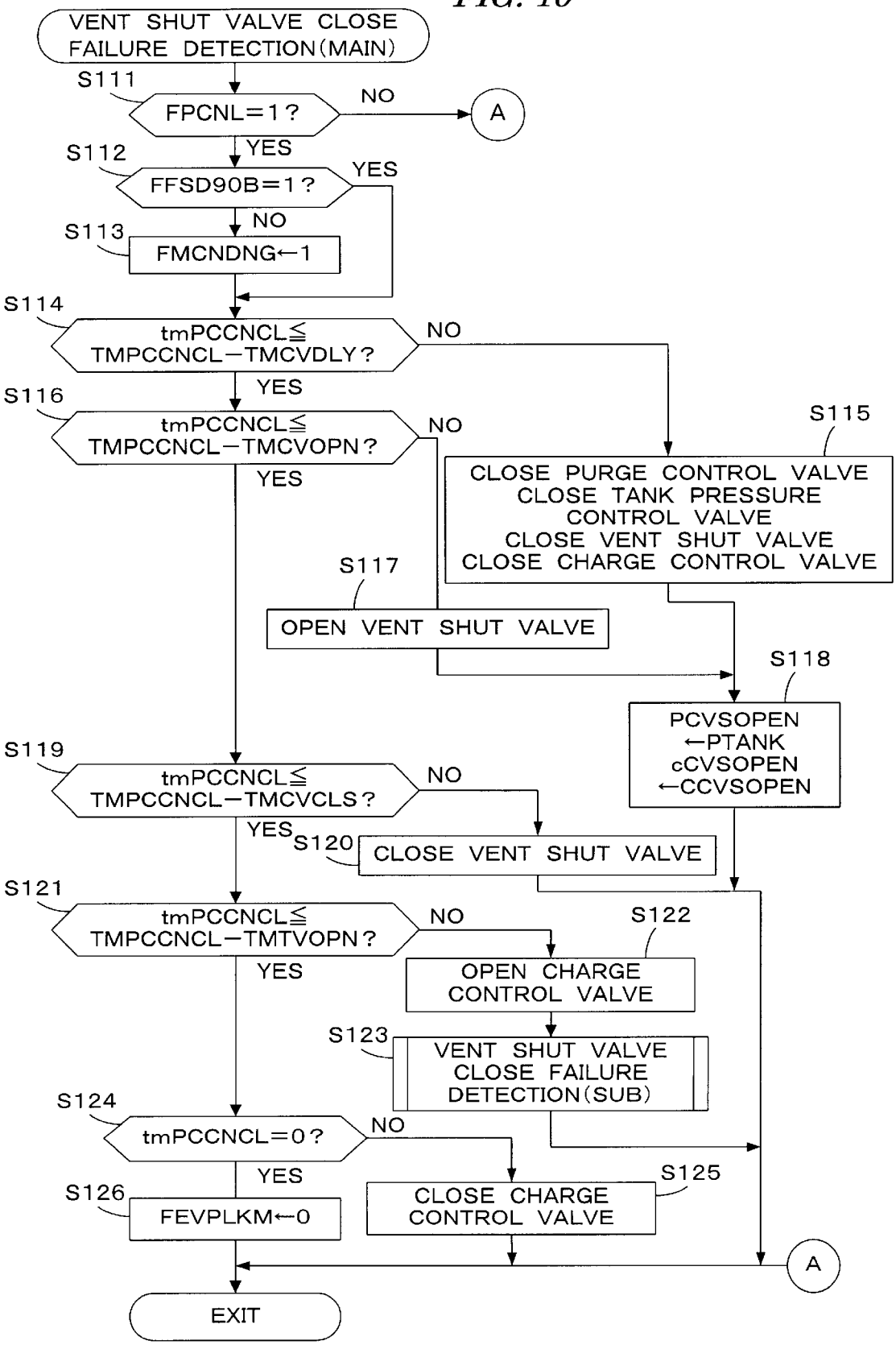
FIG. 10 is a flowchart of a vent shut valve close failure detection processing included in the processing of FIG. 2.

If the monitoring execution condition is satisfied and FEVPLKM is set to "1", then the processing goes from step S13 to step S14, in which it is determined whether or not the VSV check start flag FMCNDNG is "1". At first, FMCNDNG is "0". Therefore, an all valve closing and canister system decompression processing (step S21) illustrated in FIG. 5, a purge control valve close failure detection processing (step S22) illustrated in FIG. 7, an internal pressure stabilization processing (step S23) illustrated in FIG. 8 and a canister system leak check processing (step S24) illustrated in FIG. 9 are successively executed. Then, a down count timer tmPCCNCL which is referred to in the vent shut valve close failure detection processing illustrated in FIG. 10 is set to a predetermined time TMPCCNL (for example, 12 seconds) and started (step 25), and the vent shut valve close failure detection processing illustrated in FIG. 10 is executed (step S26). Thereafter the present processing is ended.

After the VSV re-check start flag FMCNDNG is set to "1" in the processing of FIG. 10, the processing goes from step S14 to step S15, in which it is determined whether or not the value of the timer tmPCCNCL started in step S25 is equal to "0". While tmPCCNCL is greater than "0", the processing goes to step S26 described above. After tmPCCNCL becomes "0", then the canister system monitoring permission flag FEVPLKM is set back to "0" (step S16), to thereby end the abnormality diagnosis. Thereafter, the processing goes to step S17 described above.

FIG. 3 is a flowchart of the tank pressure monitoring processing executed in step S12 of FIG. 2.

In step S31, it is determined whether or not the engine 1 is stopped. If the engine 1 is stopped, then the processing goes directly to step S42, in which the present value of the tank pressure PTANK is stored as a reference pressure PTBASE and a down count timer tmPTANK which is referred to in step S35 is set to a predetermined time TMPTANK (for example, 10 seconds) and started.

On the other hand, if the engine 1 is operating, then it is determined whether or not the value of an up count timer tm01ACR for measuring the elapsed time after the engine 1 is started is greater than or equal to a predetermined time TMPTACR (for example, 20 seconds) (step S32). If tm01ACR is greater than or equal to TMPTACR, then it is determined whether or not the canister system monitoring permission flag FEVPLKM is "0" (step S33). If FEVPLKM is "0", indicating that the abnormality diagnosis of the canister system is not permitted, then it is determined whether or not a negative pressurization execution flag FNPCACT which indicates, when set to "1", that a negative pressurization processing of the tank pressure through the tank pressure control valve 30 is being executed (before completion of the negative pressurization) is "1" (step S34).

Then, if the answer to one of steps S32 to S34 is negative (NO), that is, when the predetermined time TMPTACR has not elapsed after starting of the engine 1, when FEVPLKM is "1", indicating that the abnormality diagnosis of the canister system is being executed, or when FNPCACT is "0", indicating that the negative pressurization processing of the fuel tank is completed, the processing goes immediately to step S42.

Figure 4:
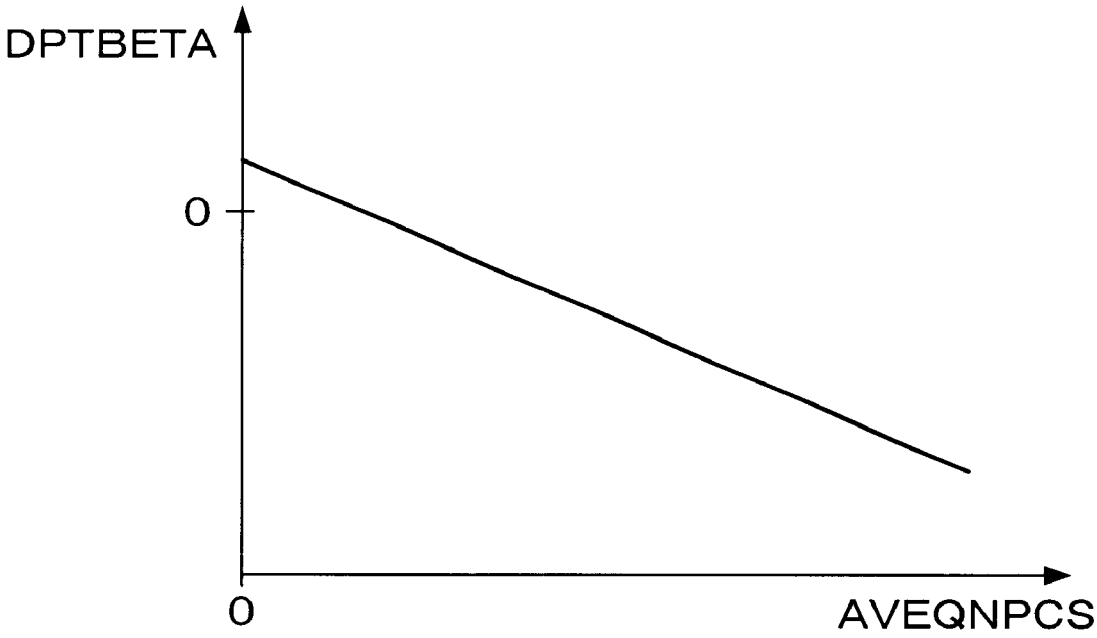
FIG. 4 is a diagram showing a table used in the processing of FIG. 3.

If all of the answers to steps S32 to S34 are affirmative (YES), that is, when the predetermined time TMPTACR has elapsed after starting of the engine 1, the abnormality diagnosis of the canister system is not being executed, and the negative pressurization processing is being executed, it is determined whether or not the value of the timer tmPTANK is lower than or equal to "0" (step S35). While tmPTANK is greater than "0", the present processing is ended immediately. When tmPTANK becomes "0", a DPTBETA table shown in FIG. 4 is retrieved according to an average flow rate AVEQNPCS of gases which pass through the tank pressure control valve 30 to determine a tank pressure change amount DPTBETA (step S36). The DPTBETA table is set such that, as the average flow rate AVEQNPCS increases, the tank pressure change amount DPTBETA decreases. It is to be noted that the average flow rate AVEQNPCS is calculated by averaging a gas flow rate QNPCS which is calculated based on the opening (opening duty) of the tank pressure control valve 30 and the pressure difference between the tank pressure PTANK and the intake pipe absolute pressure PBA.

In next step S37, it is determined whether or not the tank pressure PTANK is higher than or equal to a value obtained by adding the change amount DPTBETA to the reference pressure PTBASE stored in step S42. If PTANK is less than (PTBASE+DPTBETA), indicating that the negative pressurization processing is being executed normally, it is determined that the tank system (the fuel tank 9 and the portion of the charging passage 31 on the upstream (fuel tank) side with respect to the charge control valve 36 as well as the portion of the first evaporative fuel passage 20 on the upstream (fuel tank) side with respect to the tank pressure control valve 30) is normal, and a tank system normality flag FOK90A is set to "1" (step S40). Further, a tank system diagnosis end flag FDONE90A which indicates, when set to "1", that the abnormality diagnosis of the tank system has ended normally is set to "1" (step S41), and then the present processing goes to step S42.

On the other hand, if PTANK is greater than or equal to (PTBASE+DPTBETA) in step S37, then it is determined that the tank system has abnormality because the drop of the tank pressure PTANK is insufficient with respect to the flow rate of gases which pass through the tank pressure control valve 30, and a tank system abnormality flag FFSD90A is set to "1" (step S38). Further, the tank system diagnosis end flag FDONE90A which indicates, when set to "1", that the abnormality diagnosis of the tank system has ended is set to "1" (step S39). Thereafter the processing goes to step S42.

Figure 5:
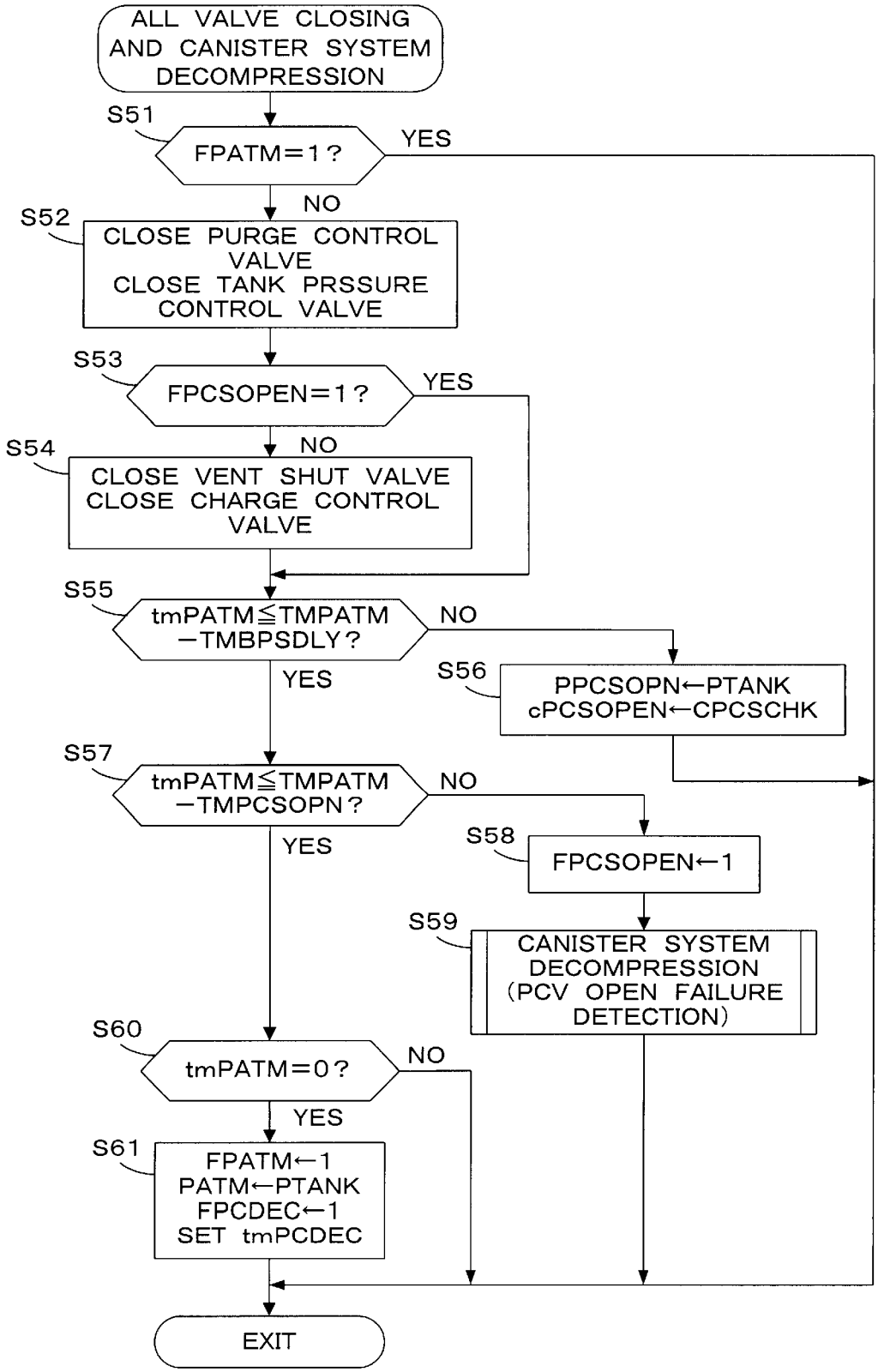
FIG. 5 is a flowchart of an all valve closing and canister system decompression processing included in the processing of FIG. 2.

FIG. 5 is a flowchart of the all valve closing and canister system decompression processing in step S21 of FIG. 2.

In step S51, it is determined whether or not a storage completion flag FPATM which is set to "1" in step S61 described below is "1". Since FPATM is "0" at first, the purge control valve 34 and the tank pressure control valve 30 are closed (step S52), and it is determined whether or not a PCV open failure detection flag FPCSOPEN is "1" (step S53). Since FPCSOPN is "0", the vent shut valve 38 is closed and the closed state of the charge control valve 36 is maintained (step S54) (refer to time t1 in FIG. 12).

Then, it is determined whether or not the value of the timer tmPATM set in step S18 of FIG. 2 is less than or equal to a value obtained by subtracting a predetermined delay time TMBPSDLY (for example, 8 seconds) from the preset value TMPATM. In other words, it is determined whether or not the predetermined delay time TMBPSDLY has elapsed after the present processing is started (step S55). While tmPTAM is greater than TMPATM−TMBPSDLY, the present value of the tank pressure PTANK is stored as a stored value PPCSOPN and a subtraction counter cPCSOPN is set to a predetermined count value CPCSCHK (for example, 2) (step S56). Thereafter, the present processing is ended.

Figure 6:
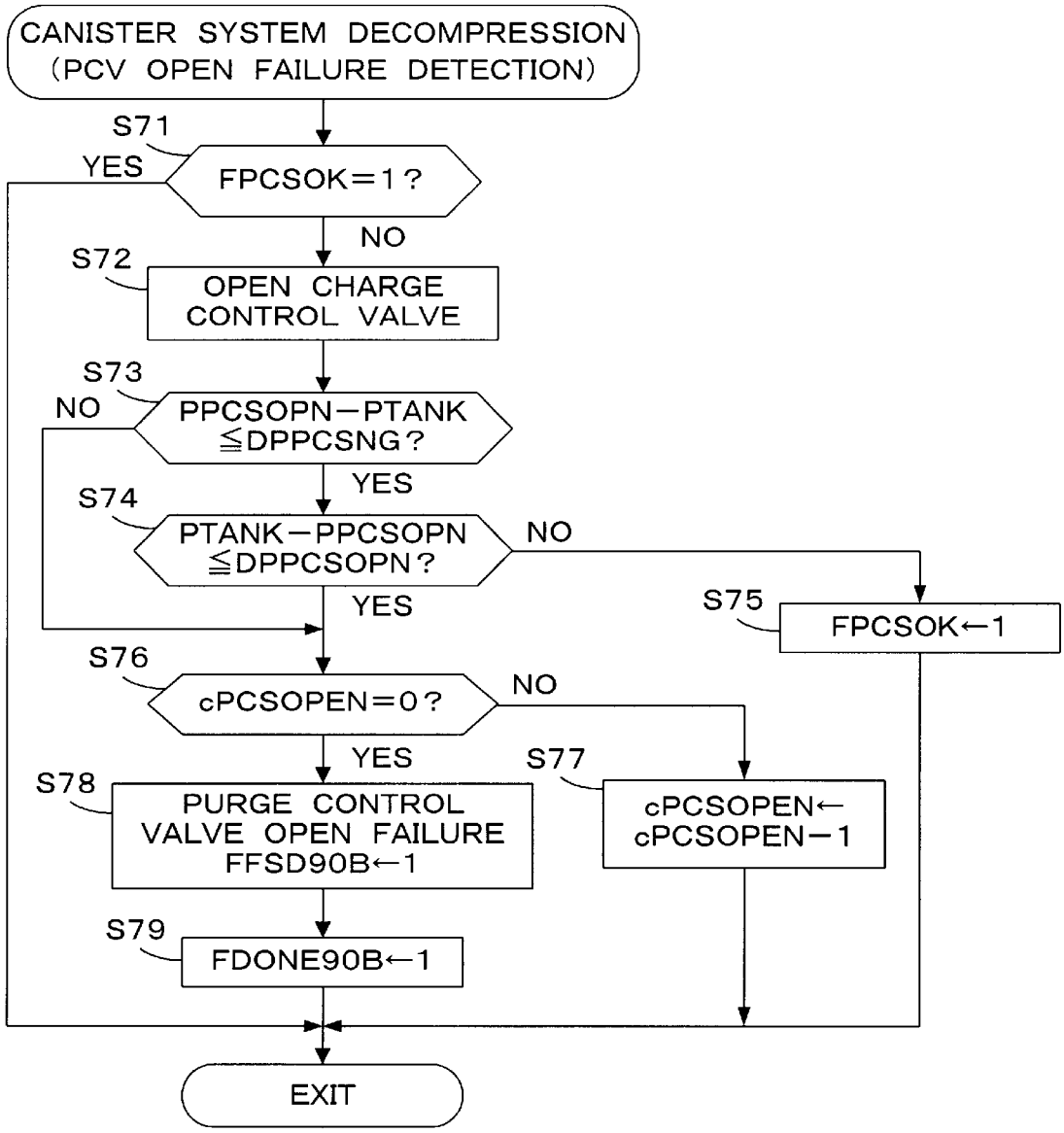
FIG. 6 is a flowchart of a canister system decompression processing included in the processing of FIG. 5.

After the predetermined delay time TMBPSDLY has elapsed, the processing goes from step S55 to step S57, and it is determined whether or not the value of the timer tmPATM is less than or equal to a value obtained by subtracting a predetermined time TMPCSOPN (for example, 10 seconds) from the preset time TMPATM. In other words, it is determined whether or not the predetermined time TMPCSOPN has elapsed after the present processing is started (step S57). While tmPTAM is greater than (TMPATM−TMPCSOPN), the PCV open failure detection flag FPCSOPEN is set to "1" (step S58), and the canister system decompression processing (PCV open failure detection processing) illustrated in FIG. 6 is executed (step S59). Once the PCV open failure detection flag FPCSOPEN is set to "1", the processing goes from step S53 directly to step S55.

Figure 7:
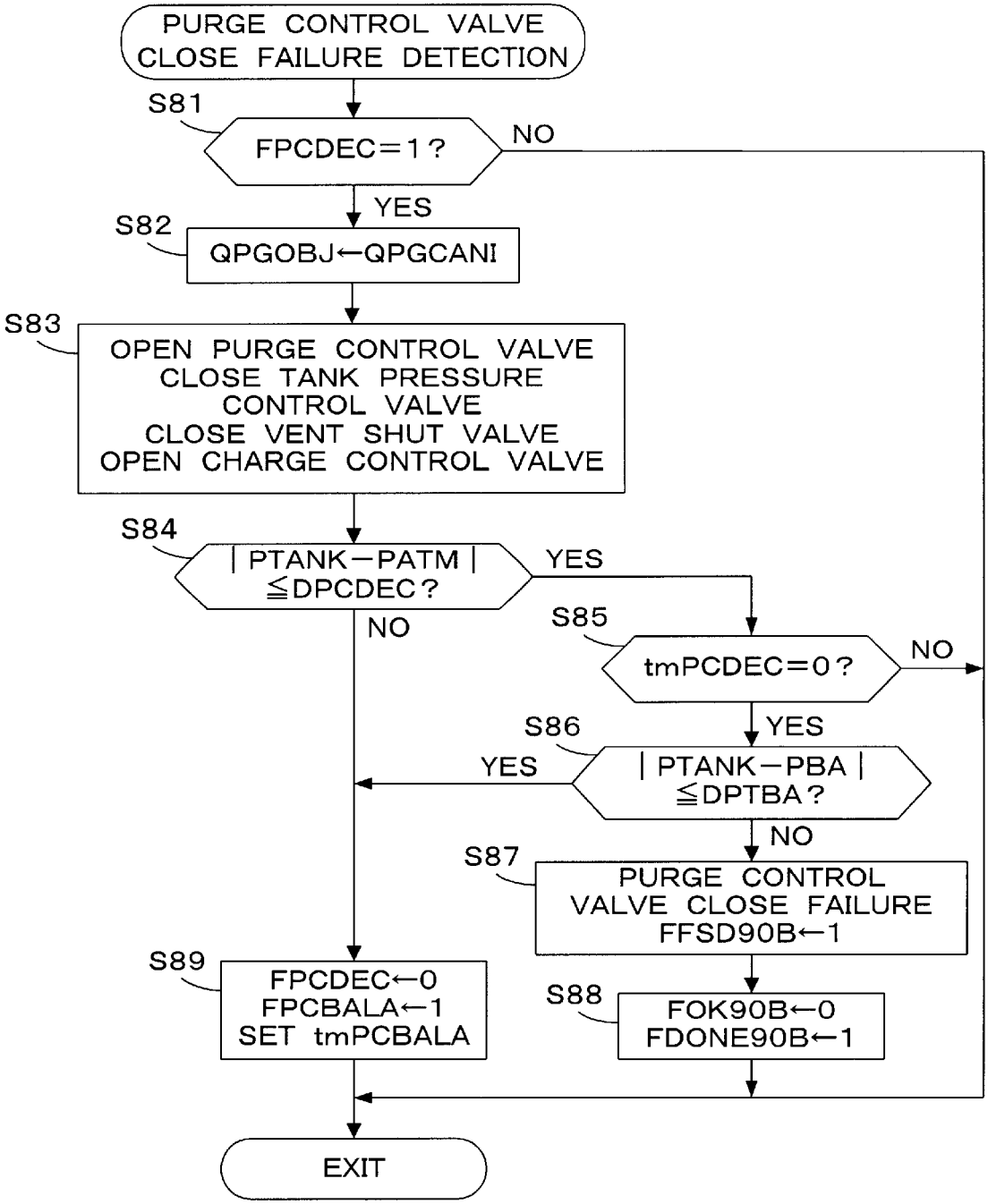
FIG. 7 is a flowchart of a purge control valve close failure detection processing included in the processing of FIG. 2.

If tmPATM is less than or equal to (TMPATM−TMPCSOPN) in step S57, the processing goes to step S60, in which it is determined whether or not the value of the timer tmPATM is "0". While tmPATM is greater than "0", the processing is ended immediately. When tmPATM becomes "0" (refer to time t3 in FIG. 12), step S61 is executed and then the present processing is ended. In step S61, the storage completion flag FPATM is set to "1" and the present value of the tank pressure PTANK is stored as the stored value PATM. Further, the PCV close failure determination flag FPCDEC is set to "1" and a down count timer tmPCDEC which is referred to in the processing of FIG. 7 is set to a predetermined time TMPCDEC (for example, 5 seconds) and started.

FIG. 6 is a flowchart of the canister system decompression processing executed in step S59 of FIG. 5. In the present processing, detection of an open failure of the purge control valve 34 (a failure that the purge control valve 34 remains open and is not closed) is performed.

In step S71, it is determined whether or not the PCVOK flag FPCSOK is "1". Since FPCSOK is "0" at first, the charge control valve 36 is opened in the all-valve closed state (step S72) (refer to time t2 in FIG. 12).

Figures 12A, 12B, 12C, 12D, 12E:
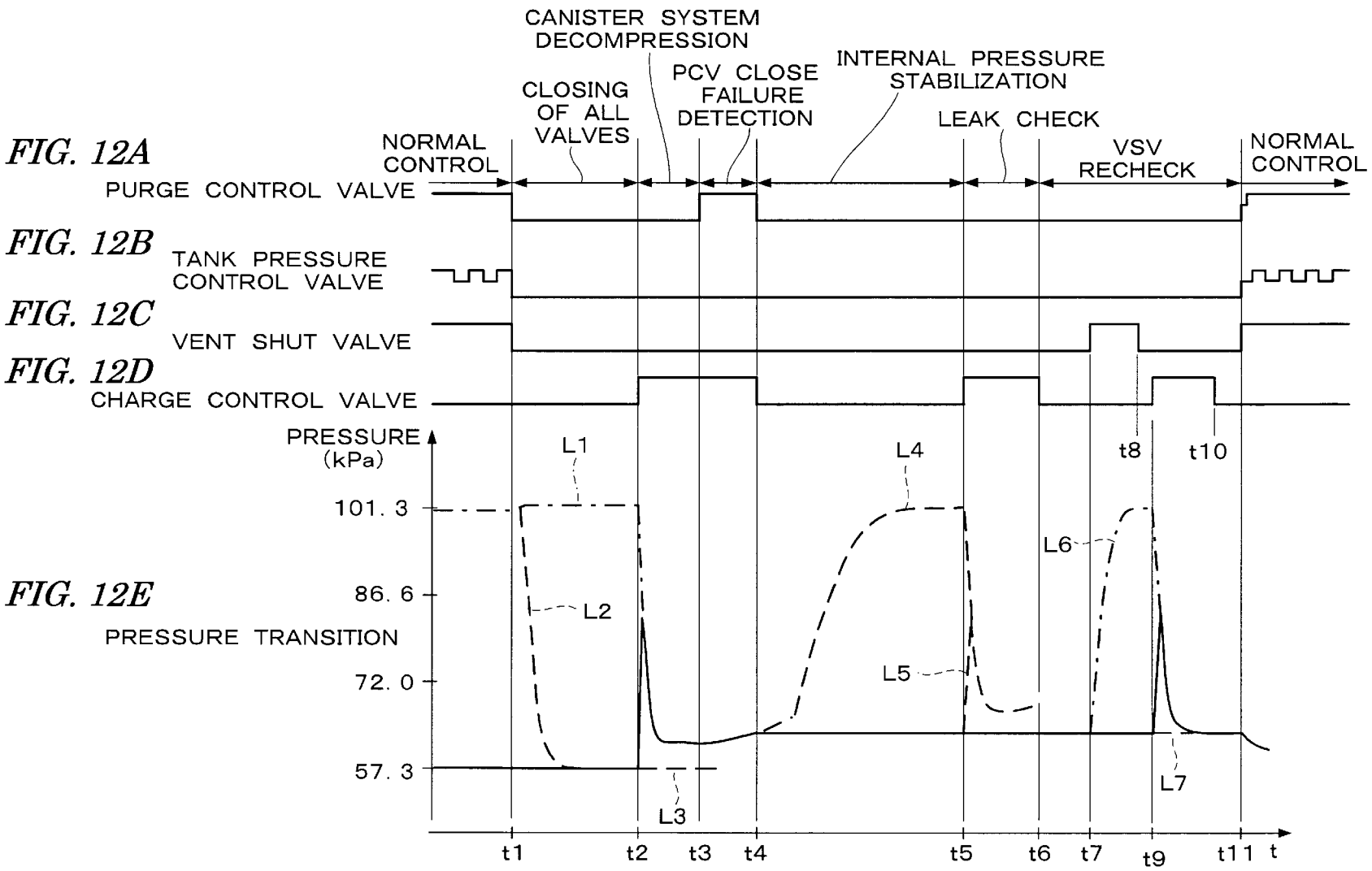
FIGS. 12A through 12E are time charts illustrating a procedure of abnormality diagnosis performed by the processing of FIG. 2.

When the purge control valve 34 is closed normally, the pressure in the canister 33 remains in the proximity of atmospheric pressure till time t2 as seen from an alternate long and short dash line L1 in FIG. 12E. Therefore, when the charge control valve 36 is opened, the pressure in the canister drops rapidly while the tank pressure PTANK indicated by a solid line in FIG. 12E temporarily rises until the pressure in the canister and the tank pressure PTANK become equal to each other. Thereafter both of the pressure in the canister and the tank pressure PTANK drop.

On the other hand, when an open failure of the purge control valve 34, the pressure in the canister drops before time t2 as indicated by a broken line L2 in FIG. 12E, and after the charge control valve 36 is opened, the tank pressure PTANK changes little as seen from a broken line L3. In steps S73 to S78 described below, such a situation described above is determined to perform the open failure detection of the purge control valve 34.

In step S73, it is determined whether or not a first pressure difference (=PPCSOPEN−PTANK) between the stored value PPCSOPN stored in step S56 of FIG. 5 and the tank pressure PTANK is lower than or equal to a decrease side predetermined change amount DPPCSNG (for example, 1.33 kPa (=10 mmHg)). When (PPCSOPN−PTANK) is less than or equal to DPPCSNG, indicating that the tank pressure PTANK has decreased little, it is determined whether or not a second pressure difference (=PTANK−PPCSOPN) between the stored value PPCSOPN and the tank pressure PTANK is lower than or equal to an increase side predetermined change amount DPPCSOPN (for example, 13.3 kPa (=100 mmHg)) (step S74). If (PTANK−PPCSOPN) is greater than DPPCSOPN, indicating that the tank pressure PTANK has increased by an amount more than the increase side predetermined change amount DPPCSOPN, then it is determined that the purge control valve 34 is normal (an open failure of the purge control valve 34 does not occur), and the PCVOK flag FPCSOK is set to "1" (step S75). Thereafter the present processing is ended. After the PCVOK flag FPCSOK is set to "1", the present processing is immediately ended after execution of step S71.

On the other hand, if (PPCSOPN−PTANK) is greater than DPPCSNG in step S73, indicating that the tank pressure PTANK drops considerably, or if (PTANK−PPCSOPN) is less than or equal to DPPCSOPN, indicating that the rise of the tank pressure PTANK is insufficient, it is determined whether or not the value of the subtraction counter cPCSOPEN initialized in step S56 of FIG. 5 is "0" (step S76). Since cPCSOPEN is greater than "0" at first, the subtraction counter cPCSOPEN is decremented by "1" (step S77). After cPCSOPEN becomes "0", then it is determined that an open failure of the purge control valve 34 has occurred, and a canister system abnormality flag FFSD90B is set to "1", which indicates that the canister system has some abnormality (step S78). Then, a canister system abnormality diagnosis end flag FDONE90B is set to "1", which indicates an end of the canister system abnormality diagnosis (step S79). Thereafter the present processing is ended.

FIG. 7 is a flowchart of the purge control valve close failure detection processing in step S22 of FIG. 2.

In step S81, it is determined whether or not the PCV close failure determination flag FPCDEC is "1". If FPCDEC is "0", then the present processing is ended immediately. In other words, the present processing is substantially executed only when FPCDEC is "1".

If FPCDEC is "1", then an target flow rate QPGOBJ of gases which pass through the purge control valve 34 is set to a predetermined flow rate QPGCANI (for example, 5 litter/min) (step S82). The purge control valve 34 is opened and the opening (duty) of the purge control valve 34 is controlled so that the actual gas flow rate may be equal to the target flow rate. Further, the tank pressure control valve 30 and the vent shut valve 38 are maintained in their closed states and the charge control valve 36 is maintained in its open state (step S83) (refer to time t3 in FIG. 12).

In next step S84, it is determined whether or not an absolute value of the pressure difference (=PTANK−PATM) between the tank pressure PTANK and the stored value PATM is lower than a predetermined pressure difference DPCDEC (for example, 0.67 kPa (=5 mmHg)). If |PTANK−PATM| is greater than DPCDEC, indicating that the tank pressure PTANK has changed in response to the opening of the purge control valve 34, it is determined that a close failure of the purge control valve does not occur. Accordingly, the PCV close failure determination flag FPCDEC is set back to "0", the internal pressure stabilization flag FPCBALA is set to "1", and a down count timer tmPCBALA is set to a predetermined time TMPCBALA (for example, 2 minutes) and started (step S89). Thereafter the present processing is ended.

If |PTANK−PATM| is less than or equal to DPCDEC in step S84, indicating that the tank pressure PTANK changes little, even if an opening control signal for the purge control valve 34 is outputted, the detection of a close failure of the purge control valve 34 (a failure that the purge control valve 34 remains in a closed state and is not opened) is performed in steps S85 and 86. Specifically, in step S85, it is determined whether or not the value of the timer tmPCDEC started in step S61 of FIG. 5 is "0". While tmPCDEC is greater than "0", the present processing is ended immediately.

After tmPCDEC becomes "0", it is determined whether or not an absolute value of the pressure difference (=PTANK−PBA) between the tank pressure PTANK and the intake pipe absolute pressure PBA is less than or equal to a predetermined pressure DPTBA (for example, 2.7 kPa (=20 mmHg)) (step S86). If |PTANK−PBA| is less than or equal to DPTBA, indicating that the difference between the tank pressure PTANK and the intake pipe internal absolute pressure PBA is small, it is considered that the change of the tank pressure PTANK is small even if the purge control valve 34 operates normally. Therefore, in such a case, the processing goes to step S89 described above without making determination of a failure.

When |PTANK−PBA| is greater than DPTBA in step S86, it is determined that a close failure of the purge control valve 34 has occurred, and the canister system abnormality flag FFSD90B is set to "1" (step S87). Further, a canister system normality flag FOK90B is set to "0" and the canister system abnormality diagnosis end flag FDONE90B is set to "1" (step S88). Thereafter the present processing is ended.

Figure 8:
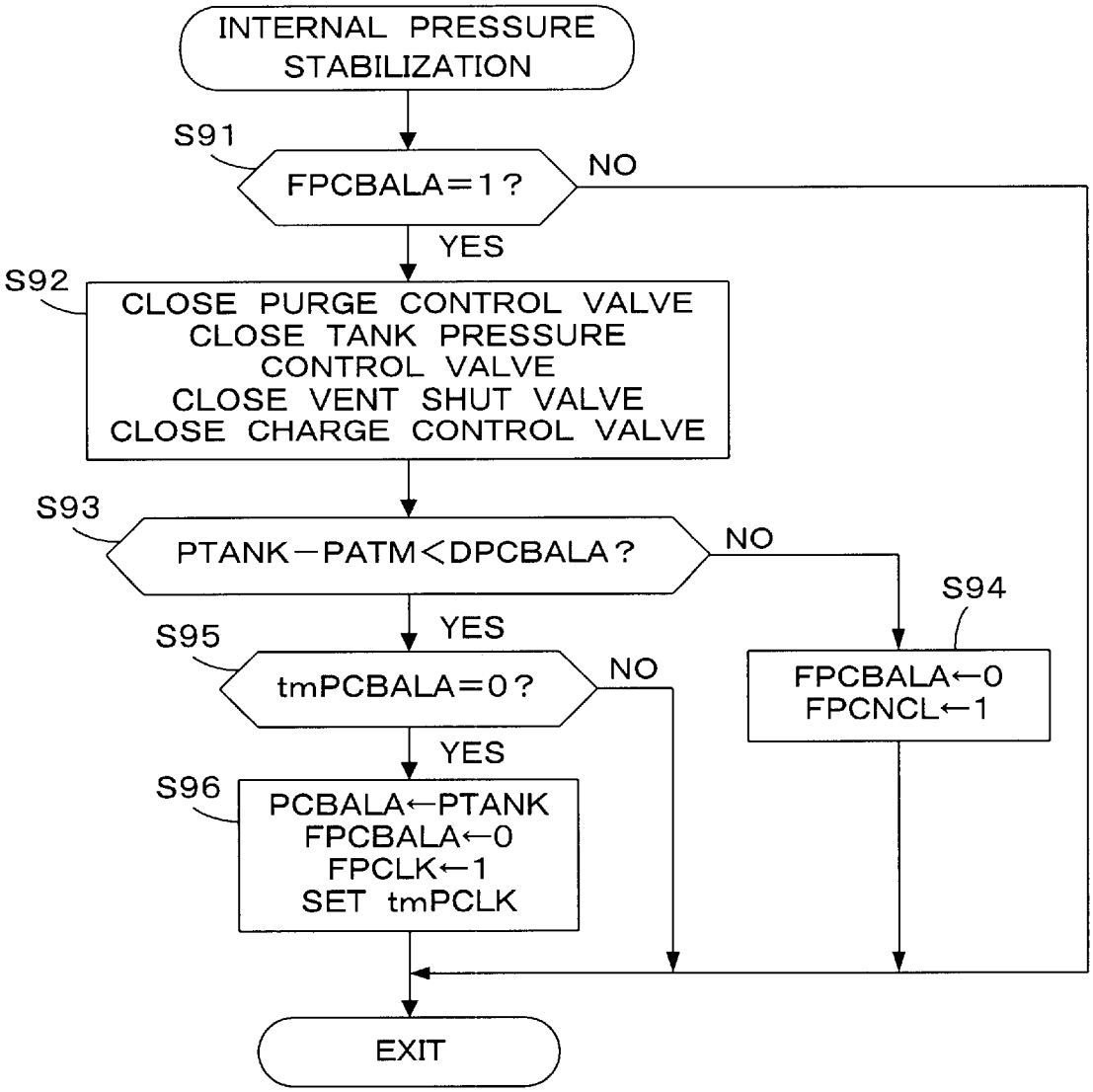
FIG. 8 is a flowchart of an internal pressure stabilization processing included in the processing of FIG. 2.

FIG. 8 is a flowchart of the internal pressure stabilization processing executed in step S23 of FIG. 2.

In step S91, it is determined whether or not the internal pressure stabilization flag FPCBALA is "1". If FPCBALA is "0", then the present processing is ended immediately. In other words, the present processing is substantially executed only when FPCBALA is "1".

When FPCBALA is "1", the purge control valve 34 and the charge control valve 36 are closed while the tank pressure control valve 30 and the vent shut valve 38 are maintained in their closed states (step S92) (refer to time t4 of FIG. 12). Then, it is determined whether or not the pressure difference (=PTANK−PTAM) between the tank pressure PTANK and the stored value PATM is less than a predetermined pressure DPCBALA (for example, 10.7 kPA (=80 mmHg)). If (PTANK PATM) is greater than or equal to DPCBALA, indicating that the rise of the tank pressure PTANK is so great that determination by the next leak check processing cannot be executed accurately, the internal pressure stabilization processing is ended, and then the internal pressure stabilization flag FPCBALA is set to "0" as well as the VSV failure determination flag FPCNCL is set to "1" in order to skip the leak check processing and execute the vent shut valve close failure detection processing (step S94). Thereafter the present processing is ended.

If (PTANK−PATM)<DPCBALA in step S93, it is determined whether or not the value of the timer tmPCBALA started in step S89 is "0" (step S95). While tmPCBALA is greater than "0", the present processing is ended immediately. After tmPCBALA becomes "0" (refer to time t5 in FIG. 12), the present value of the tank pressure PTANK is stored as a stored value PCBALA, and the internal pressure stabilization flag FPCBALA is set back to "0". Further, the leak check flag FPCLK is set to "1" and a timer tmPCLK is set to a predetermined time TMPCLK (for example, 2 seconds) (step S96). Thereafter the present processing is ended.

If there exists a leak in the canister 33, the pressure in the canister 33 rises to a value in the proximity of atmospheric pressure as indicated by a broken line L4 in FIG. 12E during the internal pressure stabilization processing. Accordingly, when the charge control valve 36 is opened at time t5, the tank pressure PTANK changes in such a manner as indicated by a broken line L5. Therefore, in the processing of FIG. 9 described below, it is determined whether or not there exists a leak in the canister system according to whether or not the tank pressure PTANK changes in such manner.

FIG. 9 is a flowchart of the canister system leak check processing executed in step S24 of FIG. 2.

In step S101, it is determined whether or not the leak check flag FPCLK is "1". When PFCLK is "0", the present processing is ended immediately. In other words, the present processing is substantially executed only when FPCLK is "1".

When FPCLK is "1", the purge control valve 34, tank pressure control valve 30 and vent shut valve 38 are maintained in their closed states and the charge control valve 36 is opened (step S102). Then, it is determined whether or not the difference (=PTANK PCBALA) between the tank pressure PTANK and the stored value PCBALA is greater than or equal to a predetermined pressure DPCANI (for example, 13.3 kPA (=100 mmHg)). If (PTANK−PCBALA) is greater than or equal to DPCANI, it is determined that the canister system is abnormal and the canister system abnormality flag FFSD90B is set to "1". Further, the canister system normality flag FOK90B is set to "0" and the canister system abnormality diagnosis end flag FDONE90B is set to "1" (step S104). Thereafter the processing goes to step S107.

When (PTANK−PCBALA) is less than DPCANI in step S103, it is determined whether or not the value of the timer tmPCLK started in step S96 of FIG. 8 is "0" (step S105). While tmPCLK is greater than "0", the present processing is ended immediately. After tmPCLK becomes "0" (refer to time t6 in FIG. 12), the processing goes to step S107.

In step S107, the leak check flag FPCLK is set back to "0" and the VSV failure determination flag FPCNCL is set to "1". Thereafter the present processing is ended.

FIG. 10 is a flowchart of a main routine of the vent shut close failure detection processing executed in step S26 of FIG. 2.

In step S111, it is determined whether or not the VSV failure determination flag FPCNCL is "1". If FPCNCL is "0", the present processing is ended immediately. In other words, the present processing is substantially executed only when FPCNCL is "1".

If FPCNCL is "1", then it is determined whether or not the canister system abnormality flag FFSD90B is "1" (step S112). If FFSD90B is "1", indicating that determination of abnormality has been made, the processing goes immediately to step S114. If FFSD90B is "0", indicating that determination of abnormality has not been made, the VSV check start flag FMCNDNG is set to "1" (step S113). Thereafter the processing goes to step S114. Once the VSV check start flag FMCNDNG is set to 1, the processing show in FIG. 2 goes from step S14 to step S15, and consequently, while the value of the timer tmPCCNCL is greater than "0", the vent shut valve close failure detection processing in step S26, that is, the present processing illustrated in FIG. 10 is executed.

In step S114, it is determined whether or not the value of the timer tmPCCNCL is less than or equal to a value obtained by subtracting a predetermined delay time TMCVDLY (for example, 4 seconds) from a preset value TMPCCNCL set for the timer tmPCCNCL. That is, it is determined whether or not the predetermined delay time TMCVDLY has elapsed after the present processing is started. Since tmPCCNCL is greater than (TMPCCNCL−TMCVDLY) at first, the charge control valve 36 is closed while the purge control valve 34, tank pressure control valve 30 and vent shut valve 38 are maintained in their closed states (step S115) (refer to time t6 in FIG. 12). Then, the present value of the tank pressure PTANK is stored as a stored value PCVSOPEN, and a subtraction counter cCVSOPEN is set to a predetermined count value CCVSOPEN (for example, 2) (step S118). Thereafter the present processing is ended.

If tmPCCNCL is less than or equal to (TMPCCNCL−TMCVDLY) in step S114, the processing goes to step S116, in which it is determined whether or not the value of the timer tmPCCNCL is less than or equal to a value obtained by subtracting a predetermined vent shut valve opening time TMCVOPN (for example, 8 seconds) from the preset value TMPCCNCL set for the timer tmPCCNCL. That is, it is determined whether or not the predetermined vent shut valve opening time TMCVOPN has elapsed after the present processing is started.

Since tmPCCNCL is greater than (TMPCCNCL−TMCVOPN) at first, the vent shut valve 38 opened in step S117 is closed (step S120) (refer to time t7 in FIG. 12), and the processing goes to step S118. While tmPCCNCL is greater than (TMPCCNCL−TMCVOPN), the states of the valves are maintained. If tmPCCNCL is less than or equal to (TMPCCNCL−TMCVOPN), the processing goes to step S119, in which it is determined whether or not the value of the timer tmPCCNCL is less than or equal to a value obtained by subtracting a predetermined vent shut valve closing time TMCVCLS (for example, 9 seconds) from the preset value TMPCCNCL for the timer tmPCCNCL. That is, it is determined whether or not the predetermined vent shut valve closing time TMCVCLS has elapsed after the present processing is started.

Since tmPCCNCL is greater than (TMPCCNCL−TMCVCLS) at first, the vent shut valve 38 opened in step S117 is closed (step S120) (refer to time t8 in FIG. 12), followed by ending the present processing. While tmPCCNCL is greater than (TMPCCNCL−TMCVCLS), the states of the valves are maintained. When tmPCCNCL is less than or equal to (TMPCCNCL−TMCVCLS), the processing goes to step S121, in which it is determined whether or not the value of the timer tmPCCNCL is lower than or equal to a value obtained by subtracting a predetermined charge control valve opening time TMTVOPN (for example, 10 seconds) from the preset value TMPCCNCL for the timer tmPCCNCL. That is, it is determined whether or not the predetermined charge control valve opening time TMTVOPN has elapsed after the present processing is started.

Figure 11:
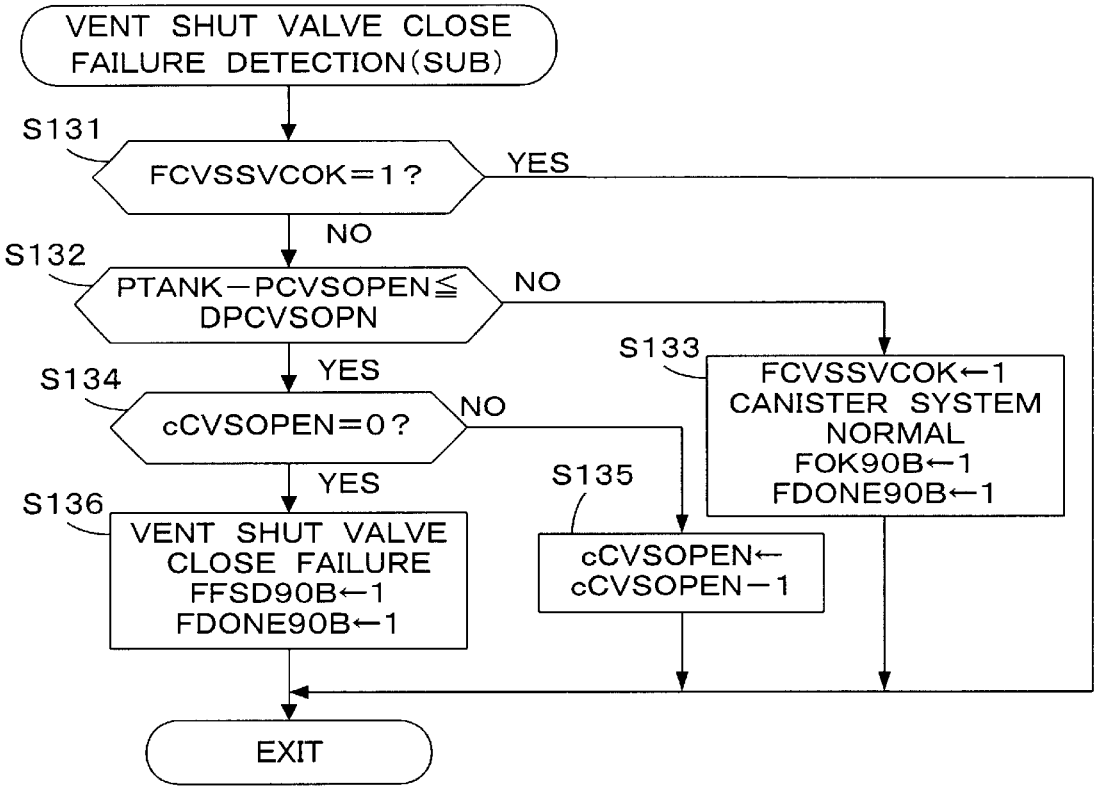
FIG. 11 is a flowchart of a vent shut valve close failure detection subroutine included in the processing of FIG. 2.

While tmCCNCL is greater than (TMPCCNCL−TMTVOPN), the charge control valve 36 is opened (step S122), and the vent shut valve close failure detection subroutine illustrated in FIG. 11 is executed (step S123) (refer to time t9 in FIG. 12).

Thereafter, when tmPCCNCL is less than or equal to (TMPCCNCL−TMTVOPN), the processing goes from step S121 to step S124, in which it is determined whether or not the value of the timer tmPCCNCL is "0". Since tmPCCNCL is greater than "0" at first, the charge control valve 36 is closed (step S125) (refer to time t10 in FIG. 12), followed by ending the present processing. While tmPCCNCL is greater than "0", the states of the valves are maintained.

If tmPCCNCL becomes "0", the canister system monitoring permission flag FEVPLKM is set back to "0" (step S126) (time t11 in FIG. 12), followed by ending the present processing. Accordingly, after the present processing is ended, normal control is started (refer to steps S13 and S17 in FIG. 2).

FIG. 11 is a flow chat of the vent shut valve close failure detection subroutine executed in step S123 of FIG. 10.

When a valve opening control signal for the vent shut valve 38 is outputted at time t7 as shown in FIG. 12E, if the vent shut valve 38 opens normally, then the pressure in the canister rises up to atmospheric pressure as seen from an alternate long and short dash line L6 of FIG. 12E. Consequently, the tank pressure PTANK rises as indicated by a solid line in FIG. 12E and the pressure in the canister drops until it becomes equal to the tank pressure PTANK. Thereafter, the pressure in the canister and the tank pressure PTANK drop similarly.

On the other hand, if the vent shut valve 38 does not open normally, the tank pressure PTANK changes little as indicated by a broken line L7 after opening the charge control valve 36. Taking notice of this point, the present processing executes detection of a close failure of the vent shut valve 38 as described below.

In step S131, it is determined whether or not the VSVOK flag FCVSSVCOK is "1". Since FCVSSVCOK is "0" at first, it is determined whether or not the difference (=PTANK−PCVSOPEN) between the tank pressure PTANK and the stored value PCVSOPEN stored in step S118 of FIG. 10 is lower than or equal to a predetermined change amount DPCVSOPN (for example, 13.3 kPa (=100 mmHg)) (step S132). As a result, when PTANK−PCVSOPN is greater than DPCVSOPN, indicating that the rise amount of the tank pressure PTANK is great, it is determined that the vent shut valve 38 is normal, and the VSVOK flag FCVSSVCOK is set to "1" (step S133). Further in step S133, the canister system normality flag FOK90B is set to "1" and the canister system abnormality diagnosis end flag FDONE90B is set to "1", followed by ending the present processing. After FCVSSVCOK is set to "1", the processing is ended immediately from step S131.

On the other hand, if (PTANK−PCVSOPN) is less than or equal to DPCVSOPN, indicating that the rise amount of the tank pressure PTANK is small, it is determined whether or not the value of the subtraction counter cCVSOPEN set in step S118 of FIG. 10 is "0" (step S134). Since cCVSOPEN is greater than "0" at first, the count value of the subtraction counter cCVSOPEN is decremented by "1" (step S135). After cCVSOPEN becomes "0", it is determined that the vent shut valve is in a close failure, and the canister system abnormality flag FFSD90B is set to "1" as well as the canister system abnormality diagnosis end flag FDONE90B is set to "1" (step S136). Thereafter the present processing is ended.

As described above in detail, according to the present embodiment, when the pressure in the fuel tank is in a predetermined negative pressure state (e.g., a state wherein the tank pressure PTANK is lower than 60 kPa (=450 mmHg)), the abnormality diagnosis of the canister system is executed. Thereupon, the abnormality diagnosis is performed by changing the open or closed state of at least one of the charge control valve 36 for opening and closing the charging passage 31, purge control valve 34 and vent shut valve 38 for opening and closing the vent passage 37 without simultaneously opening the charge control valve 36 and the vent shut valve 38, under the condition that the tank pressure control valve 30 for opening and closing the evaporative fuel passage 20 is maintained in its closed state. Therefore, the internal pressure of the fuel tank can be maintained at the negative pressure throughout execution of the abnormality diagnosis, and pressure loss by the abnormality diagnosis can be prevented to eliminate wasteful consumption of energy.

Next, abnormality diagnosis methods which are not described specifically in the above description of abnormality diagnosis processing will be described below.

1) Open failure of the charge control valve 36 (first control valve)

When the normal control is performed (when the evaporative fuel is being purged from the canister to the intake pipe), the vent shut valve (third control valve) is opened. Therefore, if the tank pressure PTANK cannot be maintained at a negative pressure during normal control, it is determined that there is a possibility of an open failure of the charge control valve 36.

2) Close failure of the charge control valve 36 (first control valve)

In the processing of FIG. 6, when the rise amount of the tank pressure PTANK immediately after time t2 (refer to FIG. 12E) is small, it is determined that the purge control valve 34 is in an open failure. Actually, however, there is a possibility that a close failure that the charge control valve 36 is not opened may have occurred. Therefore, more accurately, it is determined that an open failure of the purge control valve 34 or a close failure of the charge control valve 36 has occurred.

3) Open failure of the vent shut valve 38 (third control valve)

If it is determined in the processing of FIG. 9 that there exists a leak in the canister system, it is determined that there is a possibility that an open failure of the vent shut valve 38 may have occurred.

4) Close failure of the tank pressure control valve 30 (fourth control valve)

When the tank pressure PTANK cannot be reduced to a negative pressure during the normal control, it is determined that there is a possibility that a close failure of the tank pressure control valve 30 may have occurred.

5) Open failure of the tank pressure control valve 30 (fourth control valve)

When it is determined in the processing of FIG. 3 that the tank system is abnormal, it is determined that there is a possibility that an open failure of the tank pressure control valve 30 may have occurred.

In the embodiment described above, the tank pressure sensor 15 and the ECU 5 constitute the abnormality diagnosis apparatus, and more specifically, the processing of FIG. 2 (the processings of FIGS. 3 and 5 to 11) corresponds to abnormality diagnosis means. Further, the negative pressurization processing (not shown) of the fuel pressure executed by the ECU 5 corresponds to control means.

It is to be noted that the present invention is not limited to the specific embodiment described above and allows various modifications. For example, while, in the embodiment described above, the tank pressure sensor 15 is disposed in the charging passage 31 on the fuel tank side with respect to the charge control valve 36, the arrangement of the tank pressure sensor 15 is not limited to this. The tank pressure sensor 15 may be disposed in the fuel tank 9. In other words, the tank pressure sensor 15 may be disposed at any position at which the pressure in a portion of the system on the fuel tank side with respect to the charge control valve 36 can be detected.

Further, the "predetermined negative pressure state" in which the abnormality diagnosis is executed is not limited to a state in which the tank pressure PTANK is less than or equal to 60 kPa. The predetermined negative pressure may be set so that the peak values of the tank pressure PTANK immediately after times t2, t5 and t9 of FIG. 12E may be lower than atmospheric pressure.

What is claimed is:

1. An abnormality diagnosis apparatus for an evaporative emission control system which includes a fuel tank, a canister for adsorbing evaporative fuel generated in said fuel tank, a charging passage for connecting said canister and said fuel tank, a purge passage for connecting said canister and an intake system of an internal combustion engine, a vent passage for opening said canister to atmospheric air, an evaporative fuel passage for connecting said fuel tank and said intake system, a first control valve interposed in said charging passage for opening and closing said charging passage, a second control valve interposed in said purge passage for opening and closing said purge passage, a third control valve interposed in said vent passage for opening and closing said vent passage, a fourth control valve interposed in said evaporative fuel passage for opening and closing said evaporative fuel passage, and control means for controlling an opening of said fourth control valve so that a pressure in said fuel tank may be maintained at a predetermined pressure lower than atmospheric pressure at least during operation of said internal combustion engine, said abnormality diagnosis apparatus comprising:

tank pressure detecting means for detecting the pressure in said fuel tank; and abnormality diagnosis means for diagnosing abnormality of said evaporative emission control system based on an output of said tank pressure detecting means;

wherein said controlling means outputs a control signal for maintaining said fourth control valve in a closed state while an abnormality diagnosis is performed by said abnormality diagnosis means, and said abnormality diagnosis means performs an abnormality diagnosis by outputting a control signal for changing an open or closed state of at least one of said first, second and third control valves without opening said first and third control valves simultaneously.

2. An abnormality diagnosis apparatus for an evaporative emission control system according to claim 1, wherein said abnormality diagnosis means outputs control signals for closing said first, second and third control valves, outputs a control signal for opening said first control valve, and determines an open failure of said second control valve or a close failure of said first control valve based on a change in the pressure in said fuel tank after outputting the control signal for opening said first control valve.

3. An abnormality diagnosis apparatus for an evaporative emission control system according to claim 2, wherein said abnormality diagnosis means determines that an open failure of said second control valve or a close failure of said first control valve has occurred when the amount of change in the pressure in said fuel tank is smaller than or equal to a first predetermined change amount.

4. An abnormality diagnosis apparatus for an evaporative emission control system according to claim 1, wherein said abnormality diagnosis means outputs control signals for closing said first, second and third control valves, outputs a control signal for opening said first control valve, outputs a control signal for opening said second control valve, and determines a close failure of said second control valve based on a change in the pressure in said fuel tank after outputting the control signal for opening said second control valve.

5. An abnormality diagnosis apparatus for an evaporative emission control system according to claim 4, wherein said abnormality diagnosis means determines that a close failure of said second control valve has occurred when the amount of change in the pressure in said fuel tank is smaller than or equal to a second predetermined change amount.

6. An abnormality diagnosis apparatus for an evaporative emission control system according to claim 4, further comprising intake air pressure detecting means for detecting an intake air pressure in said intake system, wherein said abnormality diagnosis means inhibits determination of a failure of said second control valve when an absolute value of a difference between the pressure in said fuel tank and the intake air pressure in said intake system is less than or equal to a predetermined value.

7. An abnormality diagnosis apparatus for an evaporative emission control system according to claim 1, wherein said abnormality diagnosis means outputs control signals for maintaining said first, second and third control valves in a closed state in a condition where a pressure in said canister is lower than atmospheric pressure, outputs a control signal for opening said first control valve at a time when a predetermined stabilization period has elapsed, and determines whether or not there exists a leak in said canister based on a change in the pressure in said fuel tank after outputting the control signal for opening said first control valve.

8. An abnormality diagnosis apparatus for an evaporative emission control system according to claim 4, wherein said abnormality diagnosis means outputs control signals for maintaining said first, second and third control valves in a closed state after the determination of a close failure of said second control valve, outputs a control signal for opening said first control valve at a time when a predetermined stabilization period has elapsed, and determines whether or not there exists a leak in said canister based on a change in the pressure in said fuel tank after outputting the control signal for opening said first control valve.

9. An abnormality diagnosis apparatus for an evaporative emission control system according to claim 7, wherein said abnormality diagnosis means determines that there exists a leak in said canister when the amount of change in the pressure in said fuel tank is greater than or equal to a third predetermined change amount.

10. An abnormality diagnosis apparatus for an evaporative emission control system according to claim 8, wherein said abnormality diagnosis means determines that there exists a leak in said canister when the amount of change in the pressure in said fuel tank is greater than or equal to a third predetermined change amount.

11. An abnormality diagnosis apparatus for an evaporative emission control system according to claim 1, wherein said abnormality diagnosis means outputs control signals for maintaining said first, second and third control valves in a closed state in a condition where a pressure in said canister is lower than atmospheric pressure, outputs a control signal for opening said third control valve, outputs a control signal for closing said third control valve, outputs a control signal for opening said first control valve, and determines a close failure of said third control valve based on a change in the pressure in said fuel tank after outputting the control signal for opening said first control valve.

12. An abnormality diagnosis apparatus for an evaporative emission control system according to claim 11, wherein said abnormality diagnosis means determines that a close failure of said third control means has occurred when the amount of change in the pressure in said fuel tank is smaller than or equal to a fourth predetermined change amount.

* * * * *